United States Patent [19]

Kyle

[11] Patent Number: 4,974,431

[45] Date of Patent: Dec. 4, 1990

[54] DEVICE FOR TREATING MATERIALS WITH STEAM

[75] Inventor: Joseph H. Kyle, LaGrange, Ga.

[73] Assignee: Interface, Inc., Atlanta, Ga.

[21] Appl. No.: 442,225

[22] Filed: Nov. 28, 1989

[51] Int. Cl.[5] ..... D06B 5/24

[52] U.S. Cl. ..... 68/5.00 C; 68/5 D; 239/556

[58] Field of Search ..... 68/5 C, 5 D, 5 E, 6, 68/240; 26/18.5; 34/155; 239/556, 567

[56] References Cited

U.S. PATENT DOCUMENTS

| | | | |
|---|---|---|---|
| 837,281 | 12/1906 | Bray | 68/6 X |
| 1,789,213 | 1/1931 | Byrne | 68/6 |
| 1,914,024 | 6/1933 | Kasanof | 68/5 D |
| 2,008,230 | 7/1935 | Spooner | 68/5 D |
| 2,346,186 | 4/1944 | Poesl | 68/6 |
| 2,590,850 | 4/1952 | Dungler | 68/5 D X |
| 2,621,504 | 12/1952 | Spooner | 68/5 D |
| 2,686,139 | 8/1954 | Lamb et al. | 239/567 X |
| 3,281,258 | 10/1966 | Callahan | 427/55 |
| 3,585,696 | 6/1971 | Aronoff | 68/5 D X |
| 3,719,450 | 3/1974 | Burley | 68/5 D X |
| 3,726,757 | 4/1973 | Dupasquier | 34/155 X |
| 3,761,977 | 10/1973 | Rappoport | 68/5 D X |
| 3,868,215 | 2/1975 | Frezza | 68/5 E X |
| 4,005,230 | 1/1977 | Fleissner | 68/5 D X |
| 4,005,500 | 2/1977 | Rayment | 68/5 C X |
| 4,137,045 | 1/1979 | Brugman | 68/5 D X |
| 4,183,151 | 1/1980 | Frezza | 68/5 D X |

FOREIGN PATENT DOCUMENTS

| | | | |
|---|---|---|---|
| 452336 | 10/1949 | Italy | 68/5 D |
| 8537 | 3/1973 | Japan | 68/5 D |

OTHER PUBLICATIONS

Graham, "Ink Jet Systems for Dyeing and Printing of Textiles," in vol. 21, No. 6, (Jun. 1989).

Abstract of Cook, "Supersohic Steam Fixes Acid Dyes on Nylon Carpet," *Textile World*, 91–92, (Oct. 1984).

Abstract of Palmer, "Evolution of Energy-Efficient Steamers," *Am. Dyest. Rep.*, 18–20, (Aug. 1986).

*Primary Examiner*—Philip R. Coe

*Attorney, Agent, or Firm*—Kilpatrick & Cody

[57] ABSTRACT

A steamer which accelerates the fixing of dyestuffs while reducing backing distortion and minimizing crocking and the accompanying steaming method are disclosed. The steamer uses low pressure jets of steam impinging at low velocity on the upper surface of steamed materials to displace cooler embedded air and promote fixing of printed dyes. Because fixing occurs in less time and the backing is not directly exposed to the hot steam, much less curling and distortion of the backing results. Using low velocity steam also minimizes movement of fibrous surfaces to prevent excessive dye transfer between adjacent fibers.

3 Claims, 1 Drawing Sheet

DEVICE FOR TREATING MATERIALS WITH STEAM

This invention relates generally to treating materials with steam and more particularly to fixing dyestuffs on printed carpets and carpet tiles.

BACKGROUND OF THE INVENTION

Many dyes used in printing designs on carpet must be chemically fixed to the carpet fibers before the printed product may be packaged and shipped. Although existing commercial dyestuffs may be fixed at room temperature, such fixing requires a period on the order of twenty-four hours and is much too long for a production environment. Consequently, manufacturers of printed carpet utilize devices such as atmospheric steamers to heat the dyed carpet and accelerate fixing. One such steamer used in fixing dye on carpet tiles promotes more rapid fixing by conveying each tile through a cloud of atmospheric-pressure steam for approximately four and one-half minutes.

While atmospheric steamers substantially increase the quantity of printed carpet or carpet tiles which may be produced in a given period of time, such steamers are not without limitations. Because existing steamers subject carpet tiles to an environment maintained at 212° F. for several minutes, some tiles curl as their backings distort because of direct exposure to the intense heat. Such steamers also are relatively large in size, typically approximately forty feet long, to ensure adequate steaming for the tiles at conventional conveyor speeds. As can readily be imagined, substantial floor space is required for these devices.

Using atmospheric steam also results in uneven fixing of dye through the depth of the carpet. Because steam is lighter than air, cooler air embedded deep in the carpet fibers is not displaced by the steam but rather remains in contact with the dyestuffs. Such dyes remain unfixed even as the carpet exits the steamer, requiring that the carpet be washed to flush the unfixed dye. After the carpet is washed it must be dried, once again subjecting the backing to a period of intense heat, before it may be packaged and shipped.

Several systems exist for treating various materials with pressurized rather than atmospheric steam. U.S. Pat. Nos. 2,621,504 and 2,008,230 to Spooner and 3,868,215 to Frezza, for example, disclose closed systems for steaming textiles in which high velocity steam is projected onto the textiles. Even if such systems could be used for accelerating dye fixing, the mere presence of the printed material in the closed chamber for any length of time might cause the backing temperature to rise to unacceptable levels. Further, high velocity steam impinging on materials such as carpet fibers likely would cause some fibers to contact adjacent fibers. If the adjacent fibers are printed with a different color dye, crocking, or dye transfer from one colored fiber to another, may result.

SUMMARY OF THE INVENTION

The present invention accelerates dye fixing over existing techniques while minimizing crocking by using low pressure jets of steam to displace air embedded in materials such as carpet fibers. The steam, travelling at low velocity, impinges upon the surface of the carpet and heats the fibers and dyestuffs. Because the steam is directed toward the upper surface of the carpet rather than engulfing both upper and lower surfaces as a cloud would do or a closed chamber would allow, fixing occurs in much less time and with much less heating of the backing than with conventional atmospheric or closed chamber steamers and may be accomplished without washing and drying the carpet. The low velocity steam also minimizes movement of fibers to prevent dye transfer between adjacent fibers. Finally, not only does less crocking, curling, and other distortion of the backing and carpet or carpet tile result, but less floor space than atmospheric steamers is needed as well.

It is therefore an object of the present invention to provide a device for steaming materials using jets of steam directed at a surface of the materials.

It is a further object of the present invention to provide a device for displacing air embedded in the fibers of materials using low pressure jets of steam.

It is another object of the present invention to provide a device for rapidly fixing dyestuffs on printed materials while minimizing crocking.

It is yet another object of the present invention to provide a device for fixing dyestuffs on printed materials with minimal distortion and curling of the backings of the materials.

Other objects, features, and advantages of the present invention will become apparent with reference to the remainder of the written portion and the drawings of this application.

DETAILED DESCRIPTION OF THE DRAWINGS

Figure 1:
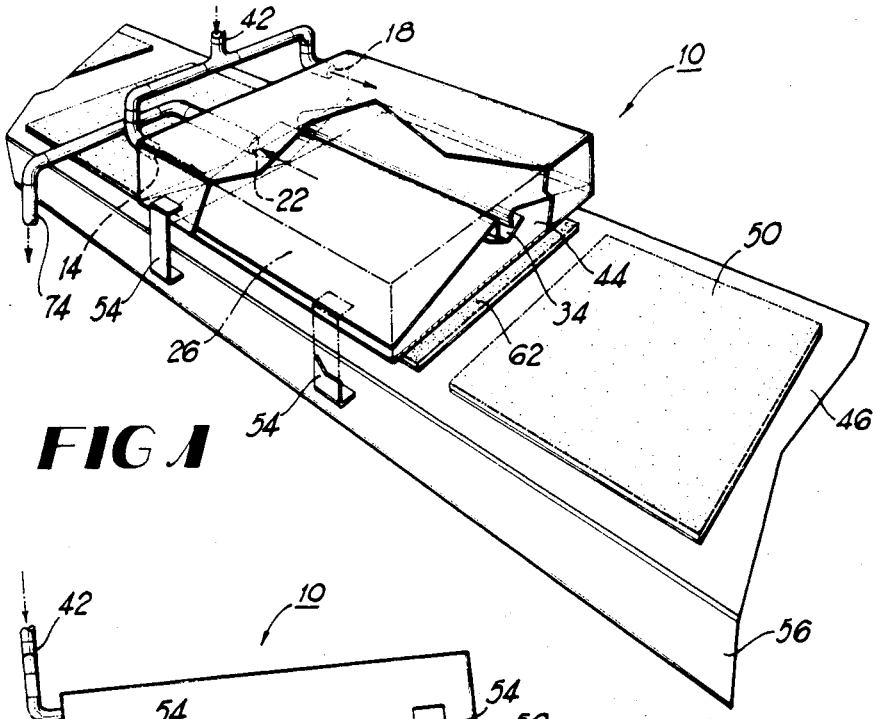
FIG. 1 is a perspective view of a steamer of the present invention disposed above a conveyor carrying carpet tiles and shown partially cut away.
Figure 2:
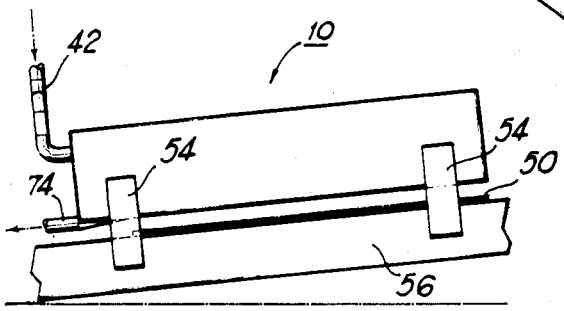
FIG. 2 is a side elevational view of the steamer of FIG. 1.
Figure 5:
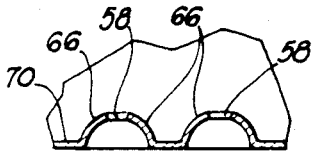
FIG. 5 is an enlarged view of a portion of the floor of the steamer of FIG. 1 as shown in FIG. 4.

FIGS. 1–5 detail the steamer 10 of the present invention. Steamer 10 includes two steam inlets 14 and 18, a condensate outlet 22, two flash chambers 26 and 30, a trough 34, and a perforated bottom 38. Steam inlets 14 and 18 allow pressurized steam travelling from any suitable steam source via pipe 42 to enter flash chambers 26 and 30, respectively. Condensate outlet 22 permits condensed water to exit the steamer away from the material to be steamed. The steam expands as it enters flash chambers 26 and 30, removing excess moisture (condensate) and allowing it to be carried to outlet 22 by trough 34. Alternatively, a burn-off pipe may be added immediately beneath trough 34 to return the condensate to steam. Finally, perforated bottom 38 permits the pressurized steam propelled from flash chambers 26 and 30 into secondary chamber 44 to exit steamer 10 directly onto the steamed material.

Steamer 10 may be a 24" × 24" × 6"metal box disposed above and approximately parallel to a conveyor 46 carrying printed or dyed carpet tiles 50 as illustrated in FIG. 1. Although conveyor 46 is shown as having a width slightly greater than one carpet tile, those skilled in the art will recognize that increasing the size of steamer 10 and width of conveyor 46 will allow multiple tiles 50 to be steamed simultaneously. Steamer 10 may be constructed of any suitable material as well. Brackets 54 mount steamer 10 to any appropriate support, such as the frame 56 supporting conveyor 46, and typically are positioned so that the distance between steamer bottom 38 and tiles 5 is approximately one inch. Conveyor 46 and steamer 10 also may (but need not) be inclined slightly along the direction of travel of the tiles 50 so that gravity will force any condensed water toward condensate outlet 22. In the embodiment illustrated in FIG. 2 steamer 10 is inclined approximately 5°, although successful trials have been conducted with steamer 10 angled as much as 20° from the horizontal plane.

Figure 3:
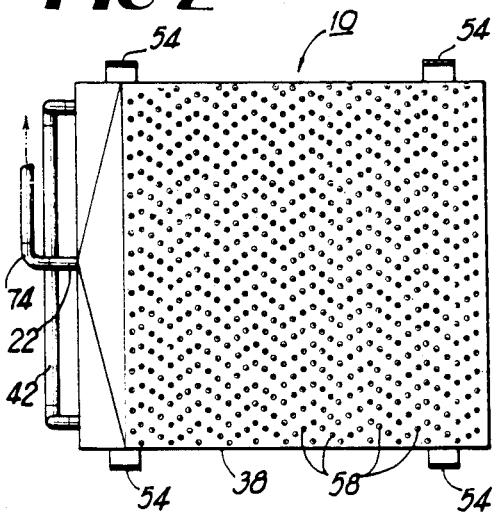
FIG. 3 is a bottom plan view of the steamer of FIG. 1.
Figure 4:
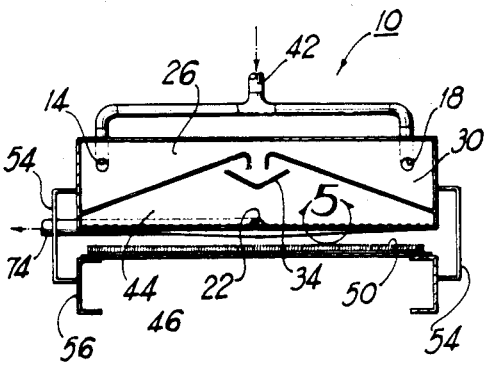
FIG. 4 is a cross-sectional view of the steamer of FIG. 1 taken along line 4—4 of FIG. 3.

As used in connection with one embodiment of the present invention, steam heated to approximately 230° F. and pressurized to between 0.4 and 1.5 inches of water travels through pipe 42 to inlets 14 and 18 and through the inlets to flash chambers 26 and 30 (FIGS. 1 and 4). From flash chambers 26 and 30 the dry steam is propelled into secondary chamber 44 and through openings 58 (FIGS. 3 and 5) at low velocity onto the upper surface 62 of the tile 50 positioned underneath steamer 10. The low velocity steam exiting the steamer 10 impinges on the fibers of the tile 50 to displace any embedded air and accelerate fixing of the dyestuffs without overheating the carpet backing or causing excessive fiber movement and consequent transfer of unfixed dye. In fact, steamer 10 is capable of fixing some commercial dyes in periods not exceeding one minute with little or no crocking or curling or distortion of the tile backing. The present steamer 10 also avoids dye transfer between fibers due to excessive moisture by causing any condensate forming within secondary chamber 44 of steamer 10 to trickle down walls 66 onto interior floor 70 and ultimately travel to condensate outlet 22 and outlet pipe 74.

FIG. 3 illustrates a series of openings 58 in bottom 38 staggered to form a "zig-zag" or chevron pattern. In one embodiment bottom 38 is a Tread-Grip Chevron Flooring made of 16 gauge CRCO steel having 0.18" diameter openings 58. Staggering the openings 58 helps prevent the fibers from overheating while the dye is being fixed. Because each carpet fiber travels essentially in a straight line along the line of travel of the conveyor, it will not be continuously subjected to the low velocity steam emitted from the staggered openings, but rather will be allowed to cool slightly between receiving jets of steam as the steam from the prior impingements rises. Those skilled in the art will recognize that other means may be employed to achieve the same result, however, and that other patterns or spacings of openings 58 may be used depending on the heat retaining characteristics of the carpet or other material to be steamed.

The foregoing is provided for purposes of illustration, explanation, and description of a preferred embodiment of the invention. Modifications and adaptations to this embodiment will be apparent to those of ordinary skill in the art and they may be made without departing from the scope and spirit of the invention. In particular, because different dye colors fix at different rates and various materials having different heat tolerances are used as backings, differing steam pressures and conveyor transport rates may be required for optimal steaming of different printed materials. Moreover, air heated to approximately 212° F. and saturated with water vapor may be used in place of steam without significantly degrading overall performance. While unsaturated hot air may be used as well, reducing the moisture content of the air prior to it entering the steamer disrupts the uniformity of the air temperature throughout the steamer and may lead to poorer results.

I claim:

1. A steamer comprising:

a. a housing having a bottom;

b. first and second inlets connected to the housing for allowing low pressure steam to enter the housing;

c. a plurality of staggered third openings in the bottom through which the steam may exit, for directing the steam at low velocity toward a fibrous material containing embedded air and unfixed fluid;

d. first and second flash chambers within the housing for receiving steam from the first and second inlets, respectively, and removing moisture from the steam;

e. a substantially v-shaped trough disposed within and spanning approximately the length of the housing above the bottom for carrying the removed moisture in both the first and second flash chambers away from the third openings;

f. a rounded wall surrounding each third opening, sloping away from the opening toward the bottom on all sides of the opening, and attached to the bottom for conveying condensate to the bottom; and g. an outlet connected to the housing for allowing condensate to drain from the bottom.

2. A device for supplying steam to accelerate fixing of dyestuffs contained in fibrous material having a backing, comprising:

a. a housing having a dimpled bottom, which dimples include openings and rounded sides surrounding and sloping away from the openings toward the bottom, and which openings are staggered in a substantially chevron-shaped pattern, for directing the steam at low velocity toward the fibrous material; and b. an inlet connected to the housing for allowing the steam to enter the housing under low pressure.

3. A device according to claim 2 further comprising means for conveying the fibrous material substantially beneath the openings so that the backing is opposite the fibrous material from the openings and is not directly impinged upon by the steam.

* * * * *